United States Patent [19]

Ackermann

[11] Patent Number: 4,710,044

[45] Date of Patent: Dec. 1, 1987

[54] RIBBON CASSETTE WITH END OF RIBBON DETECTOR

[75] Inventor: Rolf Ackermann, Nuremberg, Fed. Rep. of Germany

[73] Assignee: Ta Triumph-Adler Aktiengesellschaft, Nuremberg, Fed. Rep. of Germany

[21] Appl. No.: 1,958

[22] Filed: Jan. 9, 1987

[30] Foreign Application Priority Data

Jan. 20, 1986 [DE] Fed. Rep. of Germany ..... 3601482

[51] Int. Cl.[4] ..... B41J 32/00; B41J 35/36

[52] U.S. Cl. ..... 400/208; 400/219.1; 400/234; 400/249

[58] Field of Search ..... 400/249, 219, 219.1, 400/208, 234

[56] References Cited

U.S. PATENT DOCUMENTS 4,421,959 12/1983 Chen et al. ..... 200/243
4,616,117 10/1986 Kleine ..... 200/243

FOREIGN PATENT DOCUMENTS 0199680 12/1982 Japan ..... 400/249

*Primary Examiner*—Charles Pearson
*Assistant Examiner*—Huong Q. Pham
*Attorney, Agent, or Firm*—Browdy & Neimark

[57] ABSTRACT

A ribbon cassette for typewriters is provided with an end-of-ribbon signaling device which takes the form of a switch comprising a contact web on a ribbon tensioning lever associated with the supply spool in the ribbon cassette and two contact pins provided in the machine. The contact web is adapted to bridge the contact pins signaling end of ribbon when the ribbon supply is used up.

6 Claims, 1 Drawing Figure

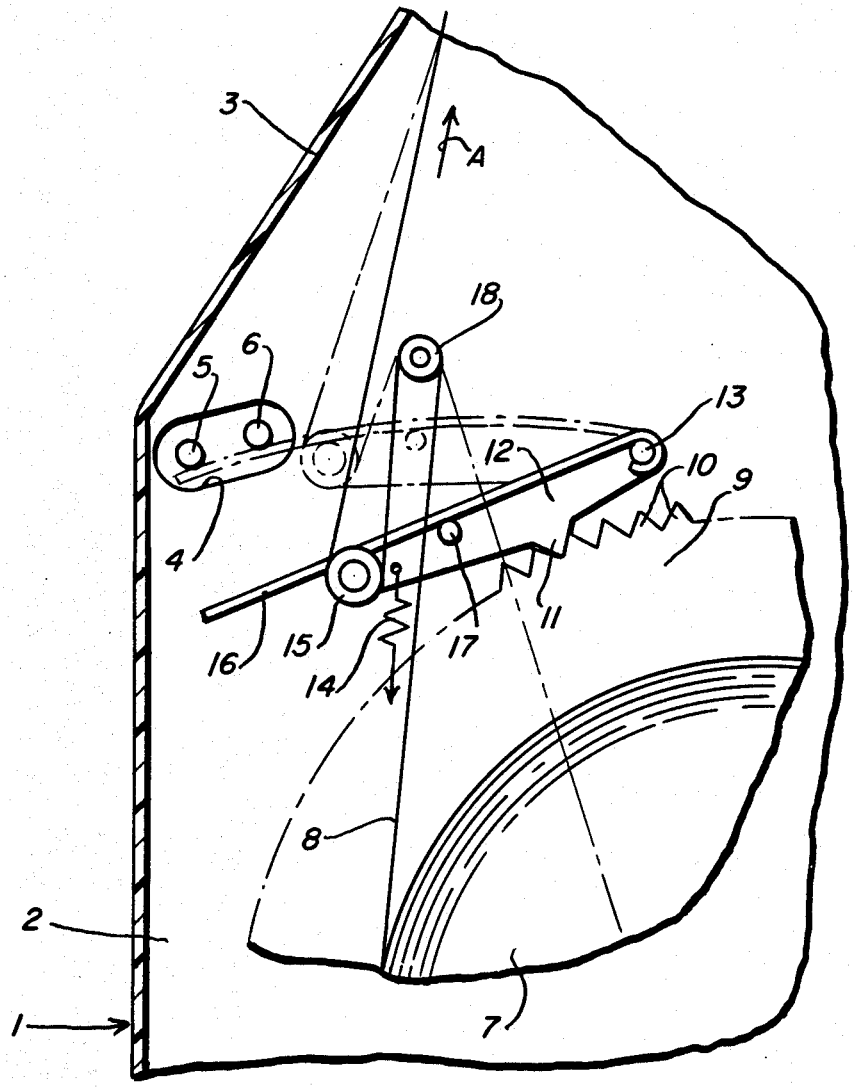
3
A
18
6
5
13
12
10
9
4
11
16
15
17
14
8
2
1
7

RIBBON CASSETTE WITH END OF RIBBON DETECTOR

BACKGROUND OF THE INVENTION

1. Field of the Invention

This invention relates to a ribbon cassette having a ribbon tensioning lever associated with an end of ribbon detector; more particularly it relates to a ribbon cassette having an end of ribbon detector comprising a movable contact associated with the ribbon tensioning lever for bridging fixed contacts on the cassette holder when ribbon tension due to an end of ribbon condition pulls said tensioning lever into contact bridging position.

2. Background Art

Typewriters with associated ribbon cassettes are known e.g. from DE-U1-84 13 712.6. These known devices require expensive light barriers. Light barriers have the additional disadvantage of also reacting to contaminations or not functioning properly when contaminated. Thus, it can happen that an "end of ribbon" signal is triggered because dirt particles have interrupted the light beam, although a ribbon supply is still there. Also, according to the state of the art, in some of the devices the ribbon itself must be designed to contain certain detectable features.

SUMMARY OF THE INVENTION

In accordance with the invention, a ribbon tightening lever is provided with an electrically conductive contact web which, when an end of ribbon condition is reached, bridges two contact pins provided on the machine, thus acting as a contact making switch. The advantage of this solution of the problem is that no expensive parts are required and great functional reliability is assured. A contact web formed of round spring steel wire is a particularly cost-effective design. The placement of the fixed contact pins on the cassette holder, which project through an opening in the cassette has the added advantage that the appropriate parts automatically assume their proper position when the ribbon cassette is placed on the cassette carrier. It is mentioned for the sake of completeness that the contact web may also be designed so as to project outwardly through a slot in the cassette sidewall, in which case the contact pins must be provided in the machine laterally to the ribbon cassette.

An object of the invention is to provide a typewriter or a printer and an associated ribbon cassette which enables detection of end of ribbon condition reliably and by means of simple parts which do not significantly increase costs.

Other objects, features and advantages of the present invention will become better known to those skilled in the art from reading the following detailed description when taken in conjunction with the accompanying drawing, wherein like reference numerals designate like or corresponding elements throughout the several views thereof.

BRIEF DESCRIPTION OF THE DRAWING

The single FIGURE of the drawing is an enlarged partial elevational view showing a top view of a part of a ribbon cassette in accordance with one embodiment of the invention, with the cassette cover removed so as to make a part of the supply spool visible.

DESCRIPTION OF PREFERRED EMBODIMENT

Referring now to the drawing, a ribbon cassette 1 as usual has a bottom 2 and an all-around sidewall 3. The bottom 2 of the cassette 1 is provided with a hole 4 through which contact pins 5 and 6 provided on the machine project into the interior of the cassette when the ribbon cassette 1 is inserted into the machine. Connected to the contact pins are electrical wires, not shown, so that the contact pins 5 and 6 act as a switch when bridged.

In the cassette a supply spool 7 supporting a coil of ribbon 8 is mounted so as to be rotatable about a pin (not visible). The supply spool 7 is disposed on a flange 9 whose rim has teeth 10. The teeth 10 interact with a tooth 11 of a ribbon tensioning lever 12 which is mounted so as to pivot about a pin 13 extending from the bottom 2 of the ribbon cassette 1 and which is biased by a spring 14 to effect engagement of teeth 10. Provided at the free end of the ribbon tensioning lever 12 is a deflection roller 15 for the ribbon 8. In addition, a contact web 16 is fastened to the ribbon tensioning lever 12 so that the contact web 16 can also pivot about the pin 13. The contact web 16 rests against a pin 17 likewise provided on the ribbon tensioning lever 12. Another upstream deflection roller 18 for the ribbon 8 extends from the bottom 2 of the ribbon cassette 1.

The contact web 16 preferably consists of round spring steel wire, but it may also be made of flat material. The pin 17 sees to it that the contact web 16 is taken along when the ribbon tensioning lever 12 is pivoted clockwise against the force of the return spring 14. The spring 14 tends to pull the tooth 11 on the ribbon tightening lever 12 into the teeth 10 on the periphery of flange 9 of the supply spool 7. Coming from the supply spool 7, the ribbon 8 is led first around the deflection roller 18 on the bottom 2 and then around the deflection roller 15 on the ribbon tensioning lever 12. As is known, the ribbon 8 is drawn out of the ribbon cassette 1 on one side through holes not shown by a known drawing off means and reenters on the other side for take-up on a driving spool (not shown).

If the supply spool 7 still contains enough ribbon, the ribbon tensioning lever 12 is pivoted slightly upon a pull on the ribbon in arrow direction A so that the tooth 11 is lifted out of the teeth 10 and the flange 9 turns clockwise together with the supply spool 7. The ribbon pull and the action of spring 14 result in constant alternating action during the typing process, so that the supply spool 7 is rotated stepwise and clockwise on the one hand, while the ribbon 8 remains taught constantly at the typing site between cassette openings. In their position at rest, both ribbon 8 and ribbon tensioning lever 12 assume the position shown in the drawing in solid lines.

During the alternating action mentioned, the contact web 16 does not touch the contact pins 5 and 6 because the ribbon tensioning lever 12 is not deflected that far under normal operating conditions. Only when the supply of ribbon 8 is used up the following happens: the end of ribbon 8 fastened to the supply spool 7 causes the ribbon tensioning lever 12, if the ribbon continues to be pulled, to be deflected further than in normal operation. This causes the loop of the ribbon 8 between the deflection rollers 18 and 15 to become smaller. Thus, the ribbon tensioning lever 12 and also the contact web 16 by means of the pin 17 are also deflected. In the sequence the contact web 16 will first contact the contact pin 5 which will not result in an end of ribbon signal per se. It is only when, due to continued transport of the ribbon 8, the contact web 16 is deflected sufficiently so far as to contact the other contact pin 6, thereby closing the electric switch consisting of the components, 5, 16 and 6. The closing of the switch may be used to trigger, e.g., an acoustic and/or optical signal; it may also be utilized to stop the machine.

The position of the ribbon 8, tensioning lever 12 and contact web 16 in closed switch position is shown in dash-dotted lines in the drawing. It is evident from this illustration and the above description that an "end-of-ribbon" signal is triggered only when the ribbon 8 is completely used up. It also becomes obvious that the ribbon pull required to cause contact making, without the risk of unintentional bridgings of the contact pins 5 and 6, is determinable by the selection of the spring characteristic of the contact web 16.

The invention claimed is:

1. An apparatus for use in a typewriter, comprising a ribbon cassette, a ribbon cassette holder therefor, and means for drawing off ribbon from a supply spool in the ribbon cassette, said ribbon cassette pivotably mounting a ribbon tensioning lever biased to normally engage said supply spool and operable in response to pull on the ribbon to draw off ribbon to release and then to reengage said supply spool after a length is drawn off, thereby to maintain ribbon tension, and an end of ribbon detector comprising two contact pins spaced at predetermined locations, and a springy contact web on said tensioning lever for bridging said contact pins when said tensioning lever is pulled by ribbon tension due to an end of ribbon condition to a respective contact making position, said springy contact web having a respective electrically conductive part for electrically bridging said contact pins, said contact pins being positioned on a line which is not parallel to said springy contact web when said springy contact web first contacts one of said pins, continued movement of said tensioning lever after said springy contact web contacts one of said pins causing said springy contact web to bend so that said springy contact web when bent simultaneously contacts both of said pins, wherein said bridging of said contact pins by said springy contact web requires said ribbon tension to be sufficient to bend said springy contact web by a predetermined amount according to the spacing of said contact pins.

2. The apparatus of claim 1, said springy contact web being a spring steel wire.

3. The apparatus of claim 1, said ribbon cassette having a hole in a wall thereof, and said contact pins projecting from said ribbon cassette holder through said hole into the interior of said cassette.

4. The apparatus of claim 1, said contact pins being located outside said ribbon cassette, and said springy contact web extending, when pulled by said ribbon tension, through a hole in said cassette to said contact making position.

5. The apparatus of claim 1, including a tooth engagement means and a plurality of teeth wherein said supply spool is prevented from rotating when engaged by said ribbon tensioning lever, as a result of said tooth engaging said plurality of teeth for maintaining of ribbon tension.

6. The apparatus of claim 1, comprising a first deflection roller mounted on said ribbon tensioning lever adjacent an end of said springy contact web which provides the bridging of said spaced contact pins, and a second deflection roller mounted on said ribbon cassette, said ribbon being pulled from said supply spool to around said second roller, and then back around said first roller.

* * * * *